US009241607B2

(12) United States Patent
Porcaro, II et al.

(10) Patent No.: US 9,241,607 B2
(45) Date of Patent: Jan. 26, 2016

(54) SILVERWARE BASKET WITH INTEGRAL SPRAY JETS FOR A DISHWASHER

(71) Applicant: ELECTROLUX HOME PRODUCTS, INC., Charlotte, NC (US)

(72) Inventors: Ralph A. Porcaro, II, Clayton, NC (US); James L. Burrows, Winterville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 515 days.

(21) Appl. No.: 13/734,454

(22) Filed: Jan. 4, 2013

(65) Prior Publication Data

US 2014/0190525 A1 Jul. 10, 2014

(51) Int. Cl.

| | |
|---|---|
| ***B08B 3/00*** | (2006.01) |
| ***A47L 15/50*** | (2006.01) |
| *A47L 15/42* | (2006.01) |

(52) U.S. Cl.

CPC ..... *A47L 15/502* (2013.01); *A47L 15/508* (2013.01); *A47L 15/428* (2013.01)

(58) Field of Classification Search

None

See application file for complete search history.

(56) References Cited

U.S. PATENT DOCUMENTS

| | | | |
|---|---|---|---|
| 2,407,533 | A | 9/1946 | Brock |
| 3,288,155 | A | 11/1966 | Swetnam |
| 3,595,253 | A | 7/1971 | Yanez Pastor |
| 3,779,258 | A | 12/1973 | Brenner et al. |
| 3,890,987 | A | 6/1975 | Marcussen et al. |
| 3,903,911 | A | 9/1975 | Guth |
| 5,697,392 | A | 12/1997 | Johnson et al. |
| 5,816,273 | A | 10/1998 | Milocco et al. |
| 6,976,496 | B2 | 12/2005 | Cantrell et al. |
| 7,137,397 | B2 | 11/2006 | Rosenbauer et al. |
| 7,210,489 | B2 | 5/2007 | Eiermann |
| 7,754,024 | B2 | 7/2010 | Koch et al. |
| 7,794,550 | B2 | 9/2010 | Roth |
| 8,007,598 | B2 | 8/2011 | Chen et al. |
| 8,038,802 | B1 | 10/2011 | Tuller |
| 2003/0041886 | A1 | 3/2003 | Cantrell et al. |
| 2005/0126607 | A1 | 6/2005 | Haft et al. |
| 2006/0236556 | A1 | 10/2006 | Ferguson et al. |
| 2008/0099055 | A1 | 5/2008 | Lemley |
| 2008/0186170 | A1 | 8/2008 | Schleifer |
| 2010/0016301 | A1 | 1/2010 | Dewdney et al. |
| 2010/0116296 | A1 | 5/2010 | Bertsch et al. |
| 2011/0186085 | A1 | 8/2011 | Chen et al. |

FOREIGN PATENT DOCUMENTS

| | | | |
|---|---|---|---|
| DE | 2 744 056 | A1 | 4/1979 |
| EP | 0 997 100 | A1 | 5/2000 |
| GB | 2 033 735 | A | 5/1980 |
| GB | 2 356 555 | A | 5/2001 |
| JP | 2002-360492 | A | 12/2002 |
| KR | 2007-037173 | A | 4/2007 |

*Primary Examiner* — Eric Golightly

(74) *Attorney, Agent, or Firm* — Alston & Bird LLP

(57) ABSTRACT

Embodiments of the present invention provide systems, methods, and apparatuses for providing dedicated spray coverage for silverware and dishware positioned within a silverware basket. In an example embodiment, the dishwasher includes a tub configured to receive dishware and a circulation system configured to circulate fluid within the tub. The dishwasher further includes a silverware basket disposed within the tub and comprising a handle portion and a basket portion. The basket portion is configured to receive dishware therein. The handle portion defines at least one spray jet opening that is configured to be in fluid communication with the circulation system and configured to direct fluid toward the basket portion.

20 Claims, 10 Drawing Sheets

SILVERWARE BASKET WITH INTEGRAL SPRAY JETS FOR A DISHWASHER

FIELD

Embodiments of the present invention relate to dishwashing appliances and, more particularly, to systems, methods, and apparatuses for directing fluid, such as wash water, in a dishwasher tub toward dishware contained in a silverware basket.

BACKGROUND

Dishwashers have become an integral part of everyday household use. Consumers place dishware and other utensils onto dishwasher racks inside dishwashers for cleaning. Dishwashers typically clean the dishware with wash systems that utilize spray arms and spray jets to propel wash water onto the dishware to remove food particles and otherwise clean the dishware.

Dishwashers often include a basket for silverware and other dishware. Properly cleaning dishware within a silverware basket, however, may be difficult. A number of factors can decrease the efficiency of the cleaning process of dishwashers that utilize spray arms with spray jets. For example, the spray of fluid may only sporadically interact with the dishware inside the silverware basket such that ineffective spray coverage of the silverware basket within the dishwasher tub results. Additionally, the structure of the silverware basket may block at least a portion of the spray of fluid. Along these lines, in some situations, a consumer may inadvertently block a spray jet of a spray arm by improperly loading dishware. As such, dishware contained in the silverware basket may not be fully cleaned during the wash cycle and multiple cycles or re-positioning of the dishware may be required.

Thus, there is a need for techniques for enhanced spray coverage of dishware contained in the silverware basket within a dishwasher tub to improve wash performance.

SUMMARY OF THE INVENTION

In light of the foregoing background, embodiments of the present invention provide systems, methods, and apparatuses for effectively cleaning dishware contained in a silverware basket. In particular, in some embodiments, the silverware basket may include a handle portion with an internal channel and integral spray jet opening(s) configured to receive fluid (e.g., wash water) and direct that fluid into the silverware basket directly. Such a direct path for the wash water may provide for more effective and efficient cleaning of the dishware contained in the silverware basket.

One embodiment is directed to a dishwasher comprising a tub configured to receive dishware and a circulation system configured to circulate fluid within the tub. The dishwasher further includes a silverware basket disposed within the tub and comprising a handle portion and a basket portion. The basket portion is configured to receive dishware therein. The handle portion defines at least one spray jet opening. The at least one spray jet opening is configured to be in fluid communication with the circulation system and configured to direct fluid toward the basket portion.

In some embodiments, the handle portion defines an internal channel configured to be in fluid communication with the at least one spray jet opening and the circulation system. In some embodiments, the handle portion is disposed above the basket portion and the at least one spray jet opening is positioned on the handle portion above the basket portion.

According to one aspect, the dishwasher further comprises a fluid branch and the circulation system comprises a circulation pump in fluid communication with a circulation conduit. The fluid branch extends from the circulation conduit. Additionally, in some embodiments, the handle portion is removably attached to the fluid branch so as to selectively enable fluid communication between the circulation conduit and the at least one spray jet opening.

In some embodiments, the silverware basket further comprises at least one spray head for each corresponding spray jet opening. Additionally, in some embodiments, the at least one spray head is configured to rotate.

In some embodiments, the dishwasher further comprises an air circulation system for circulating air through the handle portion. The at least one spray jet opening is configured to be in fluid communication with the air circulation system and configured to direct air toward the basket portion. Additionally, in some embodiments, the dishwasher further comprises a control device configured to control operation of the circulation system and the air circulation system. The control device is configured to switch between operation of the circulation system and the air circulation system so as to control when fluid is directed toward the basket portion of the silverware basket through the at least one spray jet opening and when air is directed toward the basket portion of the silverware basket through the at least one spray jet opening.

In some embodiments, the basket portion defines a first section and a second section. The first section and the second section are each configured to receive dishware therein. The handle portion may define a first spray jet opening configured to direct fluid into the first section and a second spray jet opening configured to direct fluid into the second section. In some embodiments, the handle portion defines a plurality of spray jet openings.

According to one aspect, in some embodiments, the dishwasher further comprises a lower dish rack positioned within the tub. The silverware basket is removably positioned within the lower dish rack and removably attached to the circulation system. Additionally, in some embodiments, the lower dish rack is configured to translate between a first position within the tub and a second position disposed therefrom. The handle portion is configured to be selectively in fluid communication with the circulation system when the silverware basket is within the lower dish rack and the lower dish rack is disposed in the first position and not in fluid communication with the circulation system when the silverware basket is removed from the lower dish rack or the lower dish rack is disposed in the second position. Additionally, in some embodiments, the dishwasher further comprises a lower spray arm positioned below the lower dish rack and in fluid communication with the circulation system.

Another embodiment of the present invention includes a silverware basket for a dishwasher. The dishwasher comprises a tub for receiving dishware and a circulation system for circulating fluid within the tub. The silverware basket is configured to be positioned within the tub. The silverware basket comprises a basket portion configured to receive silverware therein and a handle portion that defines at least one spray jet opening. The at least one spray jet opening is configured to be in fluid communication with the circulation system of the dishwasher. The at least one spray jet opening is configured to direct fluid toward the basket portion.

In some embodiments, the handle portion defines an internal channel that is configured to be in fluid communication with the at least one spray jet opening and the circulation system. In some embodiments, the circulation system comprises a circulation pump in fluid communication with a circulation conduit. The dishwasher comprises a fluid branch that extends from the circulation conduit. The handle portion is configured to removably attach to the fluid branch so as to selectively enable fluid communication between the circulation conduit and the at least one spray jet opening.

In some embodiments, the handle portion is disposed above the basket portion and the at least one spray jet opening is positioned on the handle portion above the basket portion.

Other embodiments provide a method of operating a dishwasher. The dishwasher comprises a tub for receiving dishware and a circulation system for circulating fluid within the tub. The method includes providing a silverware basket configured to be positioned within the tub. The silverware basket comprises a basket portion configured to receive dishware therein and a handle portion defining at least one spray jet opening. The at least one spray jet opening is configured to be in fluid communication with the circulation system and configured to direct fluid toward the basket portion. The method further comprises circulating fluid to the handle portion of the silverware basket to direct fluid toward the basket portion of the silverware basket.

In some embodiments, the method further comprises circulating air to the handle portion of the silverware basket to direct air into the basket portion of the silverware.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
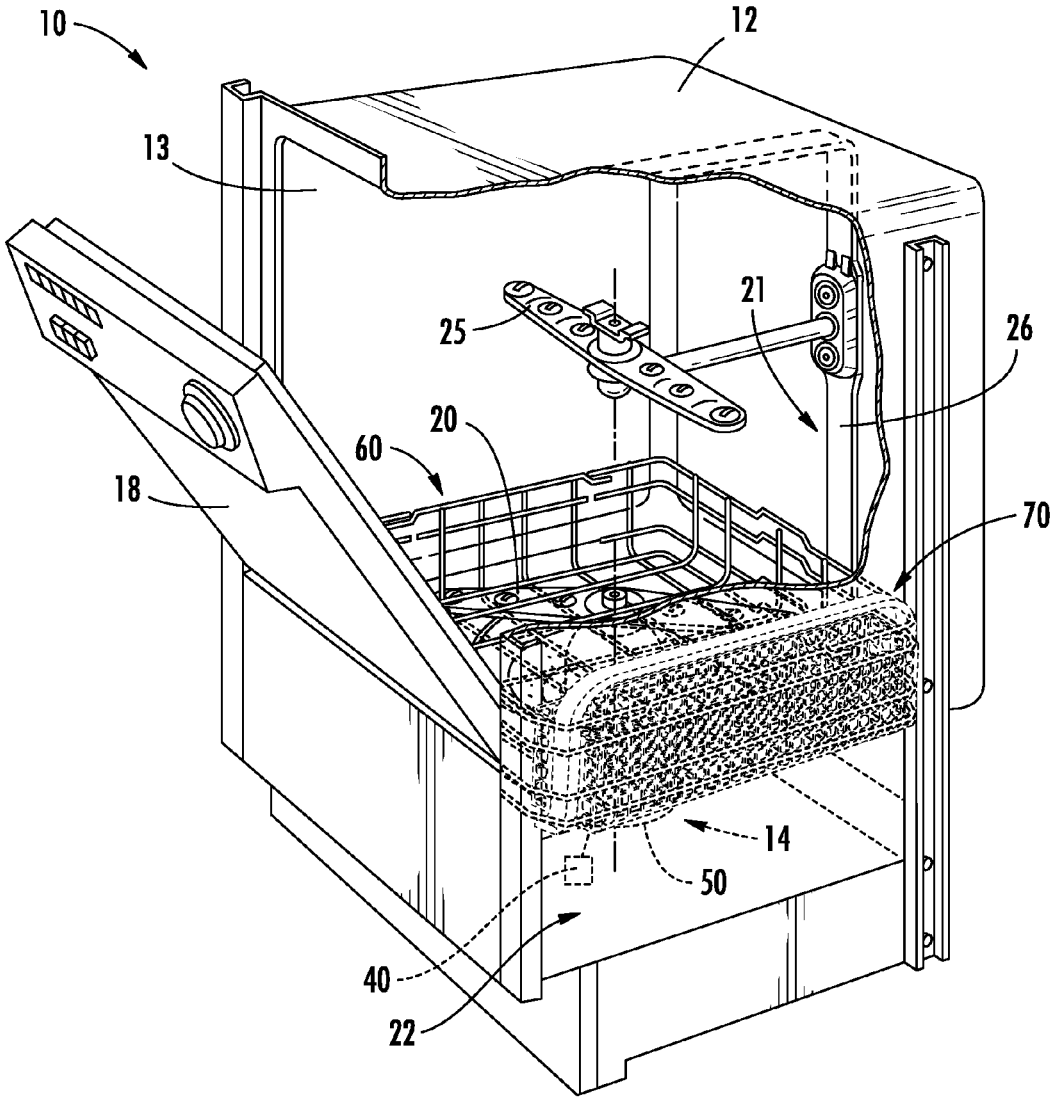
FIG. 1 is a perspective view of a partially exposed dishwasher, in accordance with some embodiments discussed herein.

FIG. 1 illustrates one example of a dishwasher 10 capable of implementing various embodiments of the present invention. Such a dishwasher 10 typically includes a tub 12 (partly broken away in FIG. 1 to show internal details), having a plurality of walls (e.g., side wall 13) for forming an enclosure in which dishware may be placed for washing. The dishwasher 10 may also include slidable lower and upper dish racks (e.g., lower dish rack 60) for holding the dishes, utensils, and dishware. As described herein, the term "dishware" may be used to describe any object configured to be positioned within the tub for cleaning in a dishwasher tub, such as dishes, utensil, silverware, etc.

In some embodiments, a door 18 may be pivotably engaged with the tub 12 to selectively permit access to the interior of the tub 12. The door 18 is configured to close to cover and seal the tub 12 when the dishwasher 10 is in operation.

The tub 12 may include a sump 14 in which wash water or rinse water is collected, typically under the influence of gravity. Additionally, in some embodiments, the dishwasher 10 may include a circulation system 21 configured to circulate fluid (e.g., wash water) through the tub 12. The wash/rinse water may be pumped through the circulation system 21 by a circulation pump 50 from the sump 14 through a circulation conduit 26 to one or more spray arms (e.g., lower spray arm 20, middle spray arm 25) mounted in the interior of the tub 12 for spraying the wash/rinse water, under pressure, onto the dishware contained therein. Additionally, as described in greater detail herein, in some embodiments, the circulation system 21 may be configured to circulate fluid to other spray jets or features, such as spray jet openings positioned on a silverware basket (e.g., silverware basket 70), in addition to the one or more spray arms.

The sump 14 and circulation system 21 may be in fluid communication with various operational components of the dishwasher 10. For example, a water valve (not shown) and a drain pump (not shown) may each be in fluid communication with the sump 14 and circulation system 21. The water valve may be configured to activate (e.g., open, turn ON, etc.) to direct water from a fluid supply/source (e.g., a household fluid conduit) to the tub 12 of the dishwasher 10. The water valve may also be configured to deactivate (e.g., close, turn OFF, etc.) to stop directing water to the tub 12. The drain pump may be configured to activate (e.g., turn ON) to remove water (or soils) from the sump 14 or tub 12.

In some embodiments, the particular operational components of the dishwasher (e.g., water valve, drain pump, corresponding hoses and wires, etc.) may be housed, disposed, or otherwise positioned within a base portion 22 positioned beneath the tub 12. In some instances, the base portion 22 may be a separate component with respect to the tub 12, such as, for example, a molded polymer component, while in other instances the base portion 22 may be integral with the tub 12 such that the side walls forming the tub 12 also at least partially form the base portion 22.

The dishwasher 10 may also comprise a control device 40, which can be used to communicate with certain components of the dishwasher 10. The control device 40 may be housed inside the base portion 22 of the tub 12 or other location so as to facilitate communication with various components of the dishwasher 10. In the depicted embodiment, the control device 40 is housed in the base portion 22 of the tub 12 and is configured to communicate with a circulation pump 50. Embodiments of the present invention contemplate communication of the control device with any of the components of the dishwasher (e.g., drain pump, water valve, circulation system 21, circulation conduit 26, etc.). In this way, the control device 40 can control activation/deactivation of any of the components of the dishwasher.

The control device 40 may be any type of device that can communicate with the components of the dishwasher 10 (e.g., electronically, mechanically, or otherwise). In the case of electronic communication, the control device 40 may include a memory for storing of programming, routines, and variables. In one embodiment, the control device 40 is a microprocessor or other processor configured to perform the functions described herein and may operate under the control of software. In such a regard, the control device 40 may be configured to execute any of the functions described herein according to various embodiments of the present invention.

Figure 2:
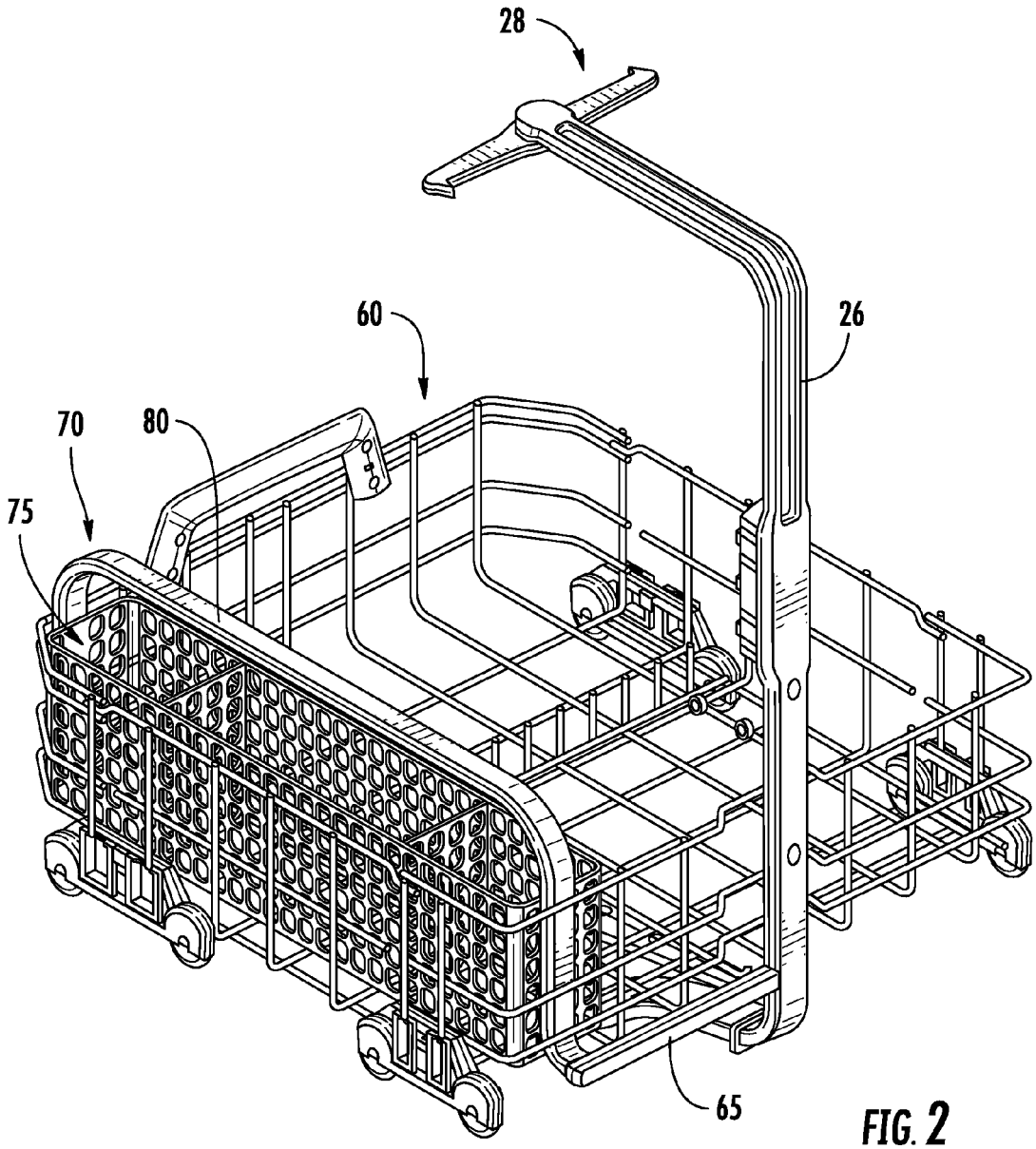
FIG. 2 is a perspective view of a portion of a circulation system, a lower dish rack, and a silverware basket of a dishwasher, in accordance with some embodiments discussed herein.

With reference to FIG. 2, the dishwasher 10 may include at least one dishwasher rack (e.g., lower dish rack 60) configured to hold dishware. The dish rack can be positioned within the tub 12 to hold dishware for cleaning, such as with wash water that is sprayed onto the dishware from the spray arms and/or spray jets (e.g., the lower dish rack 60 being positioned within the dishwasher tub 12 as shown in FIG. 1).

Additionally, in some embodiments, the dishwasher 10 may include at least one silverware basket 70 configured to hold dishware. Such a silverware basket may be useful for holding silverware or utensils for cleaning. While the silverware basket 70 is depicted to be positioned within the lower dish rack 60, some embodiments of the present invention contemplate positioning of the silverware basket 70 in other locations in the tub 12 (e.g., attached to the inside of the dishwasher door 18, inside of the tub 12, outside of a dish rack, in the upper dish rack, etc.).

As noted above, spray arms and their corresponding spray jets are often limited in the direction and angles at which they spray wash water into the tub. Moreover, often the tub may include multiple dish racks, spray arms, and many bulky dishware that may block or further limit the direction or angles at which wash water is sprayed into the tub. Thus, the proper cleaning of silverware (or other dishware) positioned within a silverware basket can be compromised.

As such, embodiments of the present invention provide systems, methods, and apparatuses for improved washing of silverware and other dishware positioned within a silverware basket. The silverware basket 70 may be disposed within the dishwasher tub 12 (shown in FIG. 1), and, in some embodiments, within a dish rack (e.g., the lower dish rack 60). Additionally, in some embodiments, as noted above and shown in FIG. 4, the dishwasher 10 may comprise a lower spray arm 20 positioned below the lower dish rack 60 and in fluid communication with the circulation system 21. While the silverware basket 70 is positioned to the side of the lower dish rack 60 in the depicted embodiment, some embodiments of the present invention contemplate the silverware basket 70 being positioned at various locations within the dish rack (e.g., at the front of the dish rack, lengthwise as shown, cross-wise, etc.).

Figure 3:
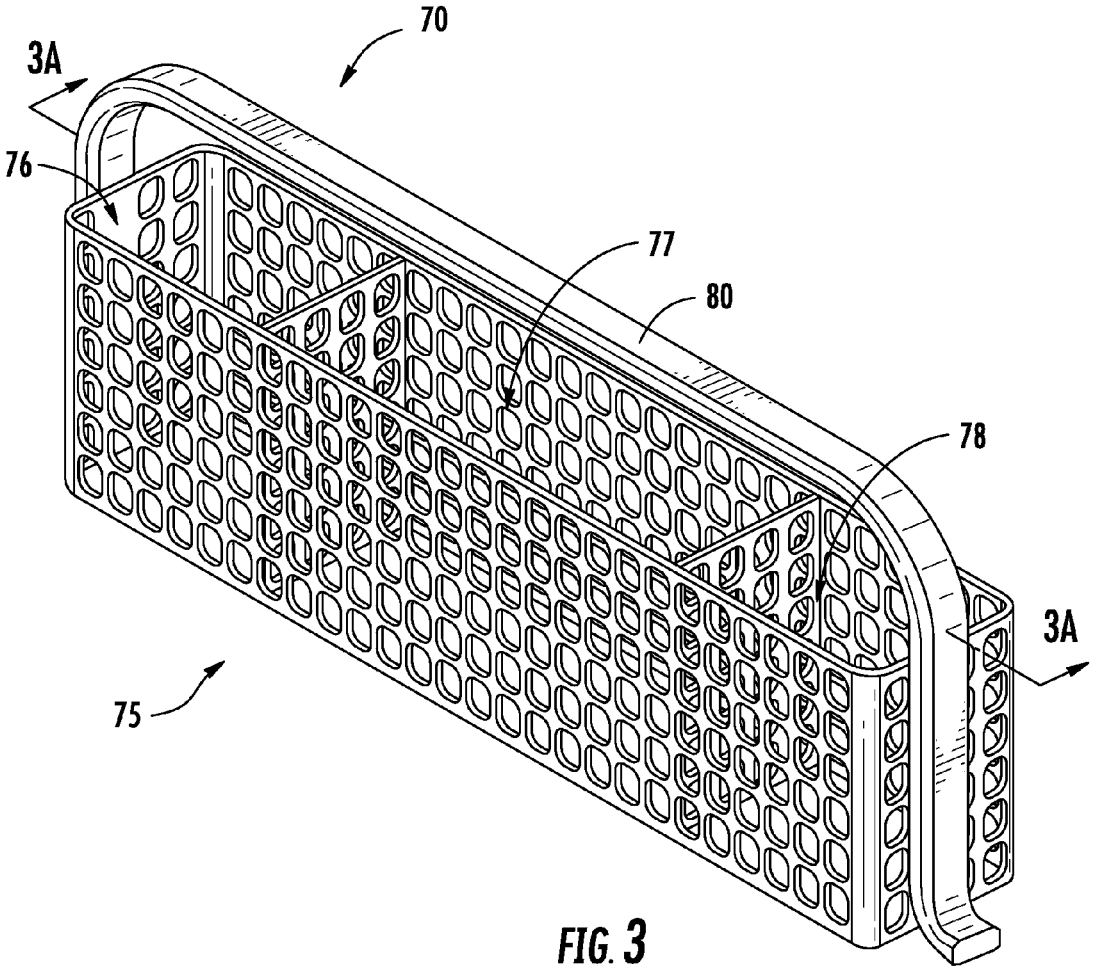
FIG. 3 is a perspective view of the silverware basket shown in FIG. 2, in accordance with some embodiments discussed herein.

With reference to FIG. 3, the silverware basket 70 includes a handle portion 80 and a basket portion 75. The basket portion 75 may be configured to receive dishware (e.g., silverware) therein and may include various configurations for receiving and holding dishware. In some embodiments, the basket portion 75 may be divided into at least two sections to separate dishware. In the depicted embodiment, the basket portion 75 defines a first section 76, a second section 77, and a third section 78. In some embodiments, each section 76, 77, 78 may define a particular volume for accommodating differently sized dishware accordingly. Additionally, in some embodiments, at least a portion of the basket portion 75 may define a mesh wall pattern (see e.g., FIG. 3) to allow fluid from external spray jets (e.g., spray jets located on one or more spray arms) to interact with the dishware contained therein, as well as allow fluid to drain into the sump 14.

Figure 3A:
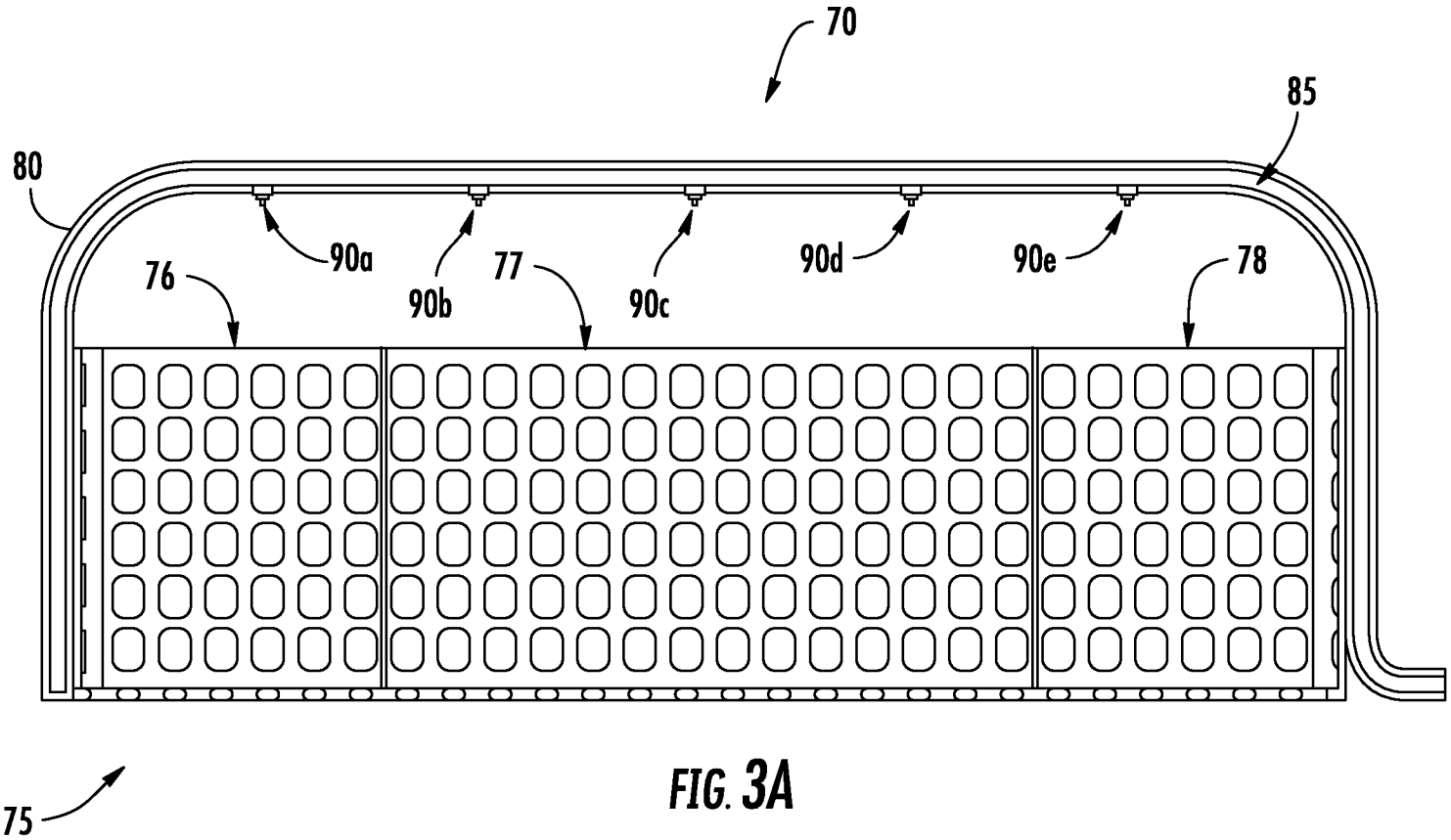
FIG. 3A is a cross-sectional view of the silverware basket shown in FIG. 3 taken along line 3A in FIG. 3, in accordance with some embodiments discussed herein.
Figure 3B:
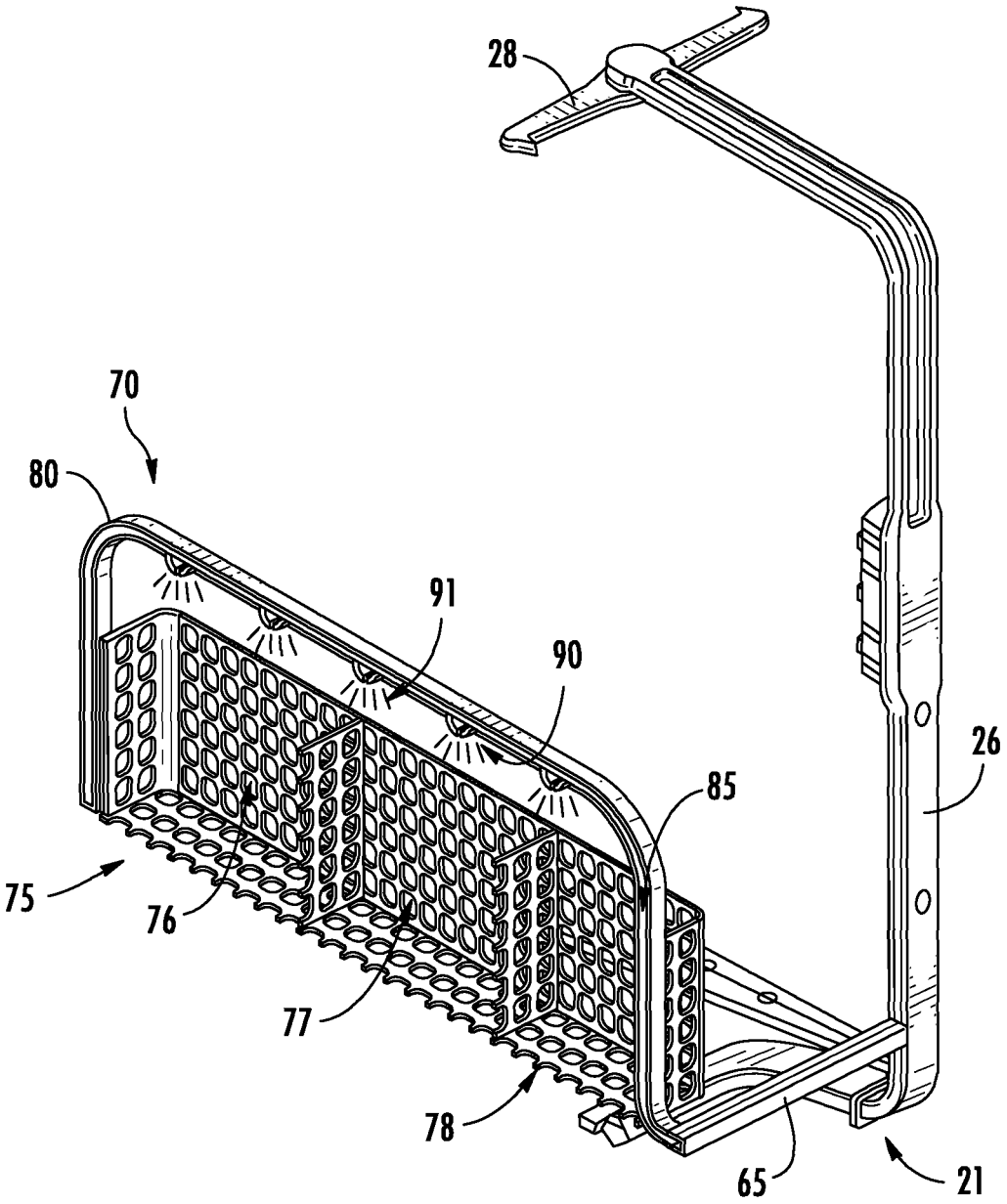
FIG. 3B is a perspective view of a portion of the circulation system shown in FIG. 2 and a cross-sectional view of the silverware basket shown in FIG. 3, wherein fluid is being directed into the silverware basket, in accordance with some embodiments discussed herein.

With reference to FIGS. 3A-3B, the handle portion 80 may define at least one spray jet opening 90. The at least one spray jet opening 90 is configured to be in fluid communication with the circulation system 21. As fluid is circulated through the circulation system 21, the internal channel 85 is in fluid communication with the circulation system 21 such that fluid flows through the internal channel 85 and is directed through at least one spray jet opening 90. For example, the handle portion 80 may define an internal channel 85 and the at least one spray jet opening 90 may be defined within the handle portion 80 in fluid communication with the internal channel 85. The internal channel 85 may be any shape and may extend through at least a portion of the handle portion 80 so as to enable selective fluid communication between the circulation system 21 and the at least one spray jet opening 90. In the depicted embodiment, the internal channel 85 extends throughout the length of the handle portion 80 in an upside down "U" shape from a channel opening 86 (shown in FIG. 4) to an opposite end of the handle portion 80. In other embodiments, the internal channel 85 may extend through only a portion of the length of the handle portion 80 (e.g., half-way through the handle portion 80, until the last spray jet opening 90*a*, etc.).

In some embodiments, with reference to FIG. 3B, the internal channel 85 of the handle portion 80 may be configured to be in selective fluid communication with the circulation system 21. As such, in some embodiments, in addition to circulating fluid to one or more spray arms (e.g., upper spray arm 28), the circulation system 21 may also be configured to circulate fluid (e.g., wash water) from the sump 14 (shown in FIG. 1) through a circulation conduit 26 to a fluid branch 65. In the depicted embodiment, the fluid branch 65 extends generally perpendicularly away from the circulation conduit 26 toward the channel opening 86 defined at one end of the handle portion 80 (shown in FIG. 4). From the fluid branch 65, fluid from the circulation conduit 26 may be directed through the internal channel 85 of the handle portion 80 to the at least one spray jet opening 90. However, it is understood that other connections between the silverware basket 70 and circulation system 21 may be employed. For example, the handle portion 80 may define a channel opening 86 that is configured to directly couple to the circulation conduit 26 such that the fluid branch 65 is not necessary.

Additionally, in some embodiments, the at least one spray jet opening 90 may be configured to direct fluid toward the basket portion 75. For example, in some embodiments, at least a portion of the handle portion 80 may be disposed above the basket portion 75, and the at least one spray jet opening 90 may be positioned on the portion of the handle portion 80 above the basket portion 75 for directing fluid therein. In such a manner, the fluid may be directed toward dishware contained within the basket portion 75 for dedicated cleaning (e.g., represented by fluid 91).

In one embodiment, fluid is directed downwardly within the basket portion 75, but could be directed at various angles depending on the configuration of the handle portion 80. Indeed, some embodiments of the present invention contemplate various configurations of the handle portion 80 with respect to the basket portion 75. For example, the handle portion 80 may be disposed on the side of the basket portion 75 (or anywhere in-between the side and above the basket portion 75). In such an embodiment, the at least one spray jet opening 90 may be designed to direct fluid at an angle toward the basket portion 75. Along these same lines, some embodiments of the present invention contemplate more than one handle portion 80 (e.g., two handles) that may be configured in various designs and positions with respect to the basket portion 75. In such embodiments, spray jet openings 90 may be positioned on the more than one handle portions 80, and each handle portion 80 may define a respective internal channel 85 such that the at least one spray jet openings 90 are each configured to be in fluid communication with the circulation system 21.

In some embodiments, the silverware basket 70 may define a plurality of spray jet openings 90. For example, the handle portion 80 of the silverware basket 70 depicted in FIG. 3B details five spray jet openings 90*a*, 90*b*, 90*c*, 90*d*, 90*e*. In such embodiments, in some cases, the handle portion 80 may define at least one spray jet opening 90*a*, 90*b*, 90*c*, 90*d*, 90*e* dedicated to direct fluid into each section 76, 77, 78. For example, the handle portion 80 defines spray jet opening 90*a*, which is configured to direct fluid into the first section 76. Along these same lines, spray jet openings 90*b*, 90*c*, 90*d* are configured to direct fluid into the second section 77, and spray jet opening 90*e* is configured to direct fluid into the third section 78.

As used herein, the at least one spray jet opening may be any type of opening, such as a small jet, multiple jets, a slot, a hole, etc., in the handle portion 80 that is configured to direct fluid into the basket portion 75.

In some embodiments, the silverware basket 70 may be removable from the dishwasher tub 12 and the circulation system 21. For example, with reference to FIGS. 4 and 5, the handle portion 80 of the silverware basket 70 may define a channel opening 86 that is configured to removably connect to the fluid branch 65 such that the internal channel 85 is in selective fluid communication with the circulation system 21 (e.g., the circulation conduit 26). For example, the channel opening 86 could be configured to connect/disconnect with the circulation system 21 (e.g., the fluid branch 65) through various means, such as force-fit, press-fit, and the like, thereby forming a fluid-tight seal therebetween.

Figure 4:
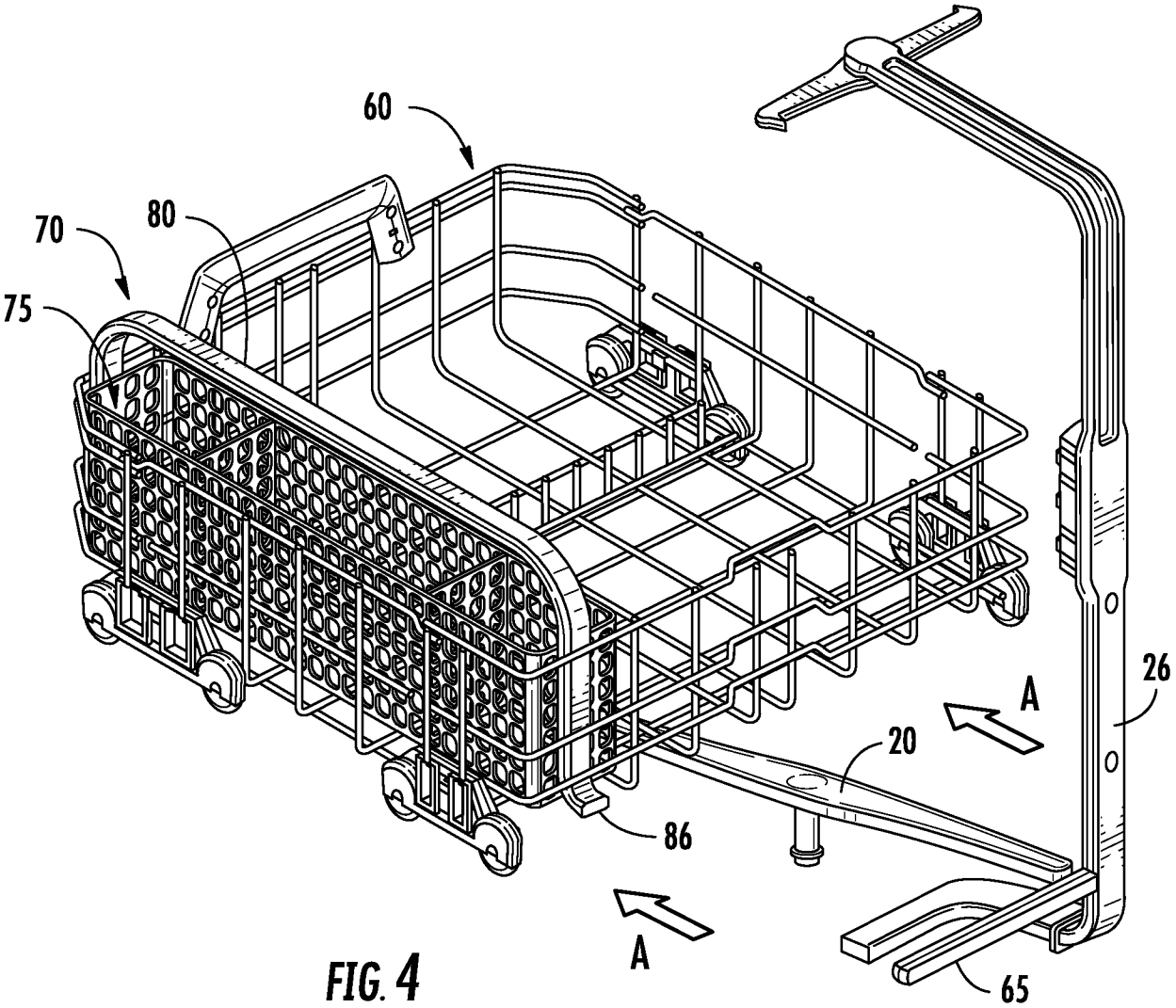
FIG. 4 is a perspective view of the portion of a circulation system, the lower dish rack, and the silverware basket of a dishwasher shown in FIG. 2, wherein the lower dish rack and the silverware basket are displaced from the circulation system, in accordance with some embodiments discussed herein.

With reference to FIG. 4, the lower dish rack 60 may be configured to translate (e.g., along arrow A) between a first position within the tub 12 (shown in FIG. 1) and a section position disposed therefrom (shown in FIG. 4) (e.g., the lower dish rack 60 may be configured to be horizontally displaced from within the tub 12). When the silverware basket 70 is disposed within the lower dish rack 60 and the lower dish rack 60 is disposed in the second position, the channel opening 86 is displaced from the fluid branch 65 such that the internal channel 85 of the handle portion 80 is not in fluid communication with the fluid branch 65 and circulation system 21. As such, the lower dish rack 60 and silverware basket 70 may be translated toward the user and outwardly of the tub 12 (e.g., toward the forward portion of the dishwasher tub 12) for easier loading and/or unloading of dishware. When the silverware basket 70 is disposed within the lower dish rack 60 and the lower dish rack 60 is translated back into the first position (e.g., opposite arrow A), the channel opening 86 is configured to be captured to the fluid branch 65 such that the internal channel 85 of the handle portion 80 of the silverware basket 70 is in fluid communication with the circulation system 21.

Figure 5:
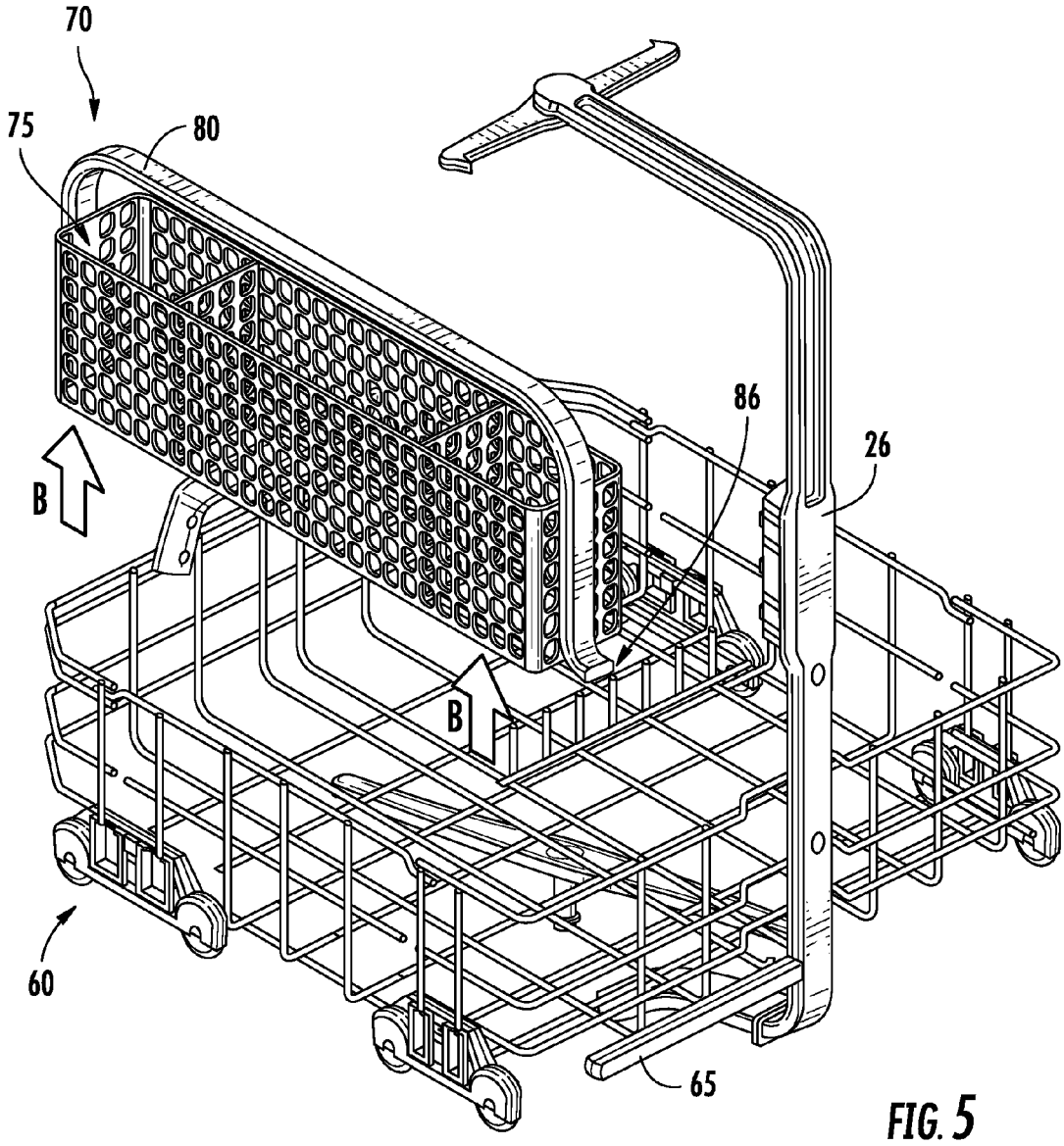
FIG. 5 is a perspective view of the portion of a circulation system, the lower dish rack, and the silverware basket of a dishwasher shown in FIG. 2, wherein the silverware basket is removed from the lower dish rack and displaced from the circulation system, in accordance with some embodiments discussed herein.

Likewise, with reference to FIG. 5, the silverware basket 70 may be removable from the lower dish rack 60. In some embodiments, the silverware basket 70 may be removable from the lower dish rack 60 regardless of the position of the lower dish rack 60 (e.g., the lower dish rack may be in the first position, the second position, or anywhere in between). For example, the silverware basket 70 may be removed, such as along arrow B, from the lower dish rack 60. In one example, the silverware basket 70 may be configured to be vertically displaced from the lower dish rack 60. When the silverware basket 70 is displaced from the lower dish rack 60 (shown in FIG. 5), the channel opening 86 may be disconnected from the fluid branch 65 such that the internal channel 85 of the handle portion 80 is not in fluid communication with the fluid branch 65 and circulation system 21. As such, the silverware basket 70 may be removable for easier loading and/or unloading of dishware. When the silverware basket 70 is positioned back into the lower dish rack 60 and the lower dish rack 60 is disposed in the first position, the channel opening 86 is coupled to the fluid branch 65 such that the internal channel 85 of the handle portion 80 of the silverware basket 70 is in fluid communication with the circulation system 21.

Thus, in some embodiments, the handle portion 80 of the silverware basket 70 is configured to be selectively in fluid communication with the circulation system 21 when the silverware basket 70 is within the lower dish rack 60 and the lower dish rack 60 is disposed in the first position. Likewise, the handle portion 80 of the silverware basket 70 is configured to be selectively not in fluid communication with the circulation system 21 when the silverware basket 70 is removed from the lower dish rack 60 or the lower dish rack 60 is disposed in the second position.

Figure 6:
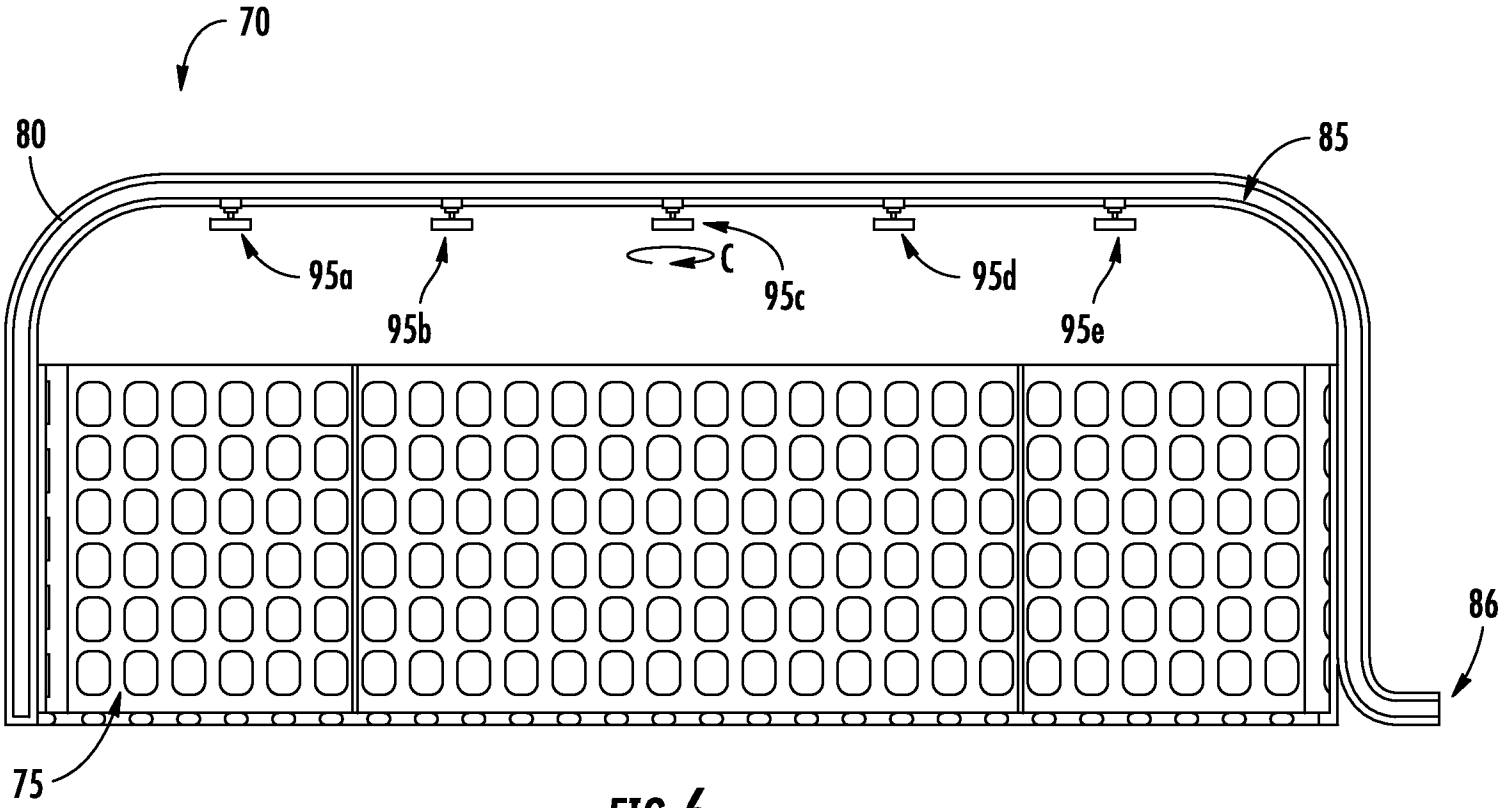
FIG. 6 is a cross-sectional view of a silverware basket with rotatable spray jets, in accordance with some embodiments discussed herein.

In some embodiments, the silverware basket 70 may include at least one spray head for each corresponding spray jet opening. For example, with reference to FIG. 6, each spray jet opening 90*a*, 90*b*, 90*c*, 90*d*, 90*e* of the handle portion 80 of the silverware basket 70 may include a corresponding spray head 95*a*, 95*b*, 95*c*, 95*d*, 95*e*. The spray head 95 may be in fluid communication with the internal channel 85 and configured to spray fluid, such as into the basket portion 75 of the silverware basket 70. Additionally, in some embodiments, the spray head 95 may be rotatable (e.g., represented by arrow C) so as to create a greater spray coverage of the fluid. In some embodiments, the spray head 95 may be any type of spray head, such as rotatable, translatable, pulsating, directional, etc.

Figure 7:
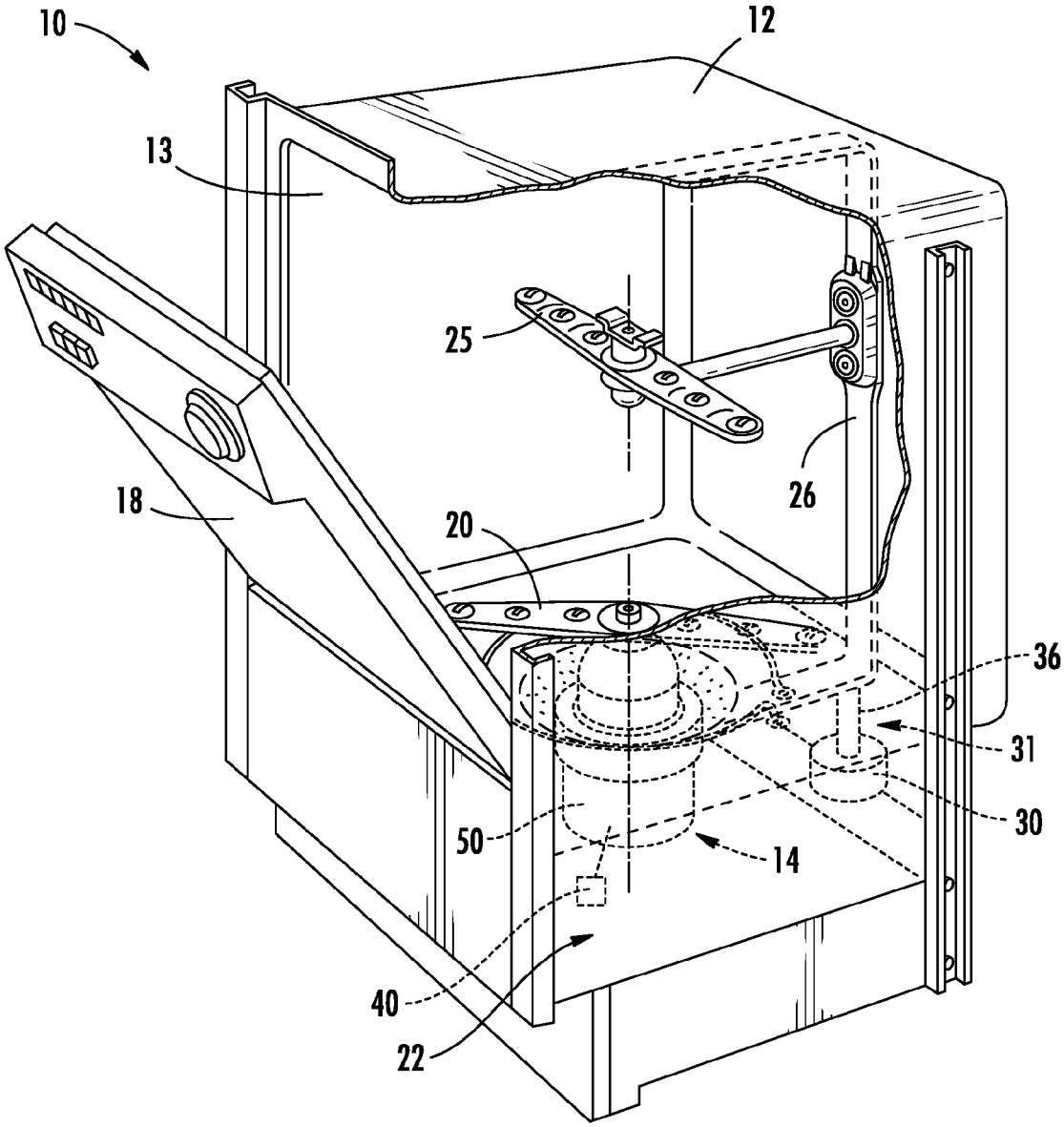
FIG. 7 is a perspective view of a partially exposed dishwasher, in accordance with some embodiments discussed herein.
Figure 8:
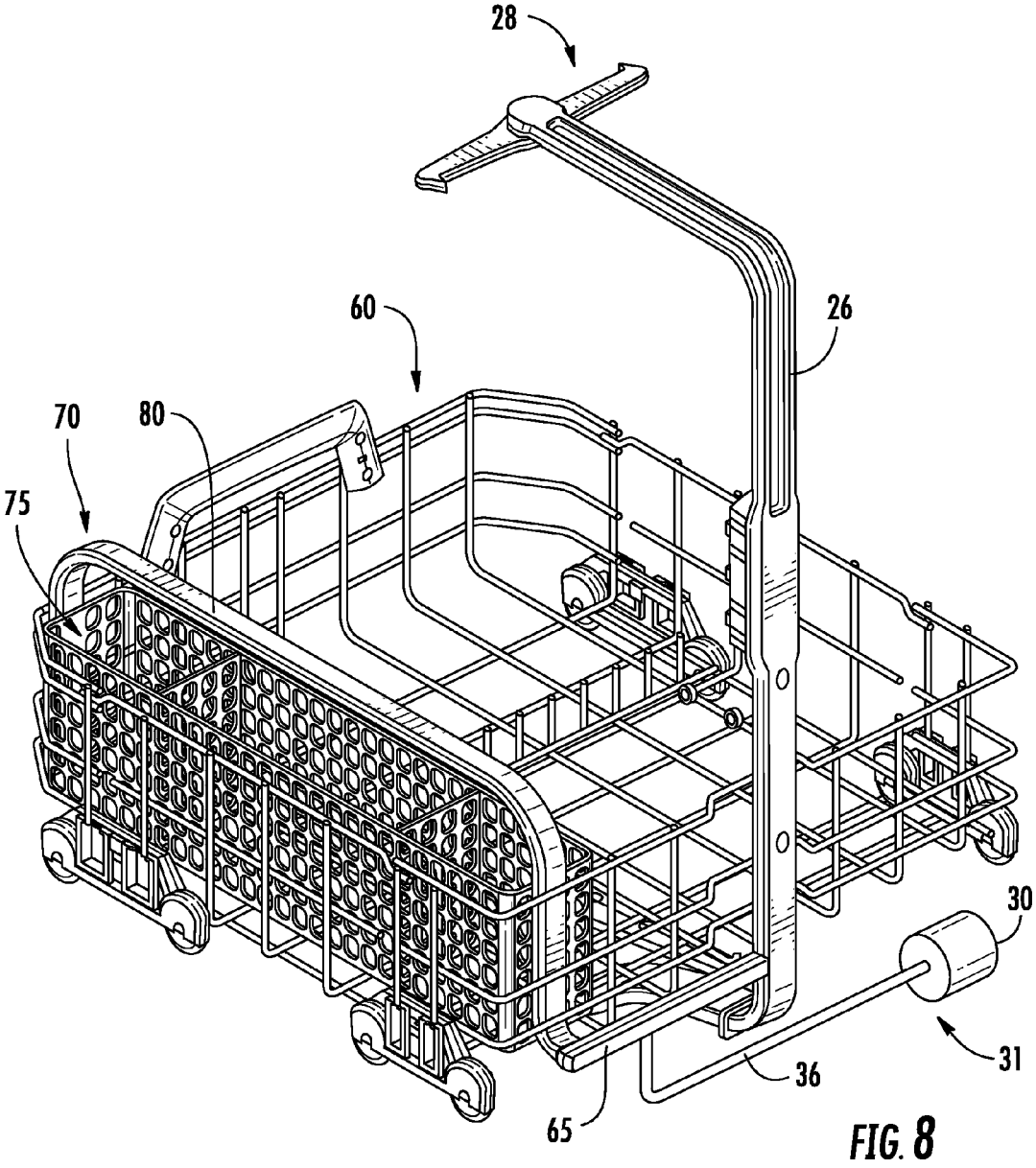
FIG. 8 is a perspective view of a portion of a water circulation system, an air circulation system, a lower dish rack, and a silverware basket of a dishwasher, in accordance with some embodiments discussed herein.

In some embodiments, the dishwasher may comprise an air circulation system that is configured to circulate air through the spray jet openings in the handle portion of the silverware basket to aid in drying the dishware contained in the silverware basket. With reference to FIG. 7, the air circulation system 31 may include an air circulation device 30 (e.g., blower, fan, or other air circulation means). The air circulation device 30 may be configured to draw in air and provide the air to the handle portion 80 of the silverware basket 70 through an air circulation conduit 36. For example, with reference to FIG. 8, in some embodiments, the air circulation conduit 36 may be in fluid communication with the fluid branch 65 so as to be in fluid communication with the internal channel 85 of the handle portion 80. In such a manner, air may be provided to the internal channel 85 and the corresponding spray jet openings 90 for directing air toward the basket portion 75.

In some embodiments, the control device 40 may be configured to control operation of the circulation system 21 and the air circulation system 31. The control device 40 may be configured switch between operation of the circulation system 21 and the air circulation system 31 so as to control when fluid (e.g., wash water) is directed toward the basket portion 75 of the silverware basket 70 through the at least one spray jet opening 90 and when air is directed toward the basket portion 75 of the silverware basket 70 through the at least one spray jet opening 90. In such an embodiment, the fluid and air can be selectively provided directly to the dishware contained in the silverware basket in order to provide for effective and efficient cleaning and drying, respectively.

In some embodiments, in order to selectively provide fluid or air to the spray jet openings, the fluid branch 65 may include separate channels for the air and fluid respectively. Additionally, in some embodiments, in order to prevent cross flow between the fluid and air, a valve or other device may be used at or near the channel opening 86 for each channel. Thus, actuation of the valve may selectively allow air or fluid to be directed through a respective channel into the internal channel 85.

While the above described embodiment details the fluid branch 65 connecting to both the circulation conduit 26 and the air circulation conduit 36, some embodiments of the present invention contemplate other configurations. For example, the air circulation conduit 36 may directly connect to the internal channel 85 of the silverware basket 70 at the channel opening 86 or at another opening.

Another embodiment of the present invention is a method for operating a dishwasher and providing dedicated fluid coverage for dishware contained in a silverware basket. The method may comprise steps for operating a dishwasher in accordance with any of the embodiments of the present invention as described herein. In some embodiments, the method may include providing a dishwasher comprising a tub for receiving dishware and a circulation system for circulating fluid within the tub. The method further comprises providing a silverware basket configured to be positioned within the tub. The silverware basket includes a basket portion configured to receive dishware therein and a handle portion defining at least one spray jet opening. The at least one spray jet opening is configured to be in fluid communication with the circulation system and to direct fluid toward the basket portion. The method further comprises operating the circulation system to provide fluid to the handle portion of the silverware basket to direct fluid toward the basket portion of the silverware basket. In some embodiments, the method may comprise providing air to the handle portion of the silverware basket from an air circulation system to direct air toward the basket portion of the silverware basket.

Another embodiment of the present invention is a method of manufacturing a dishwasher for providing dedicated fluid coverage for dishware contained in a silverware basket. The method may comprise providing and assembling any components in accordance with any of the embodiments of the present invention as described herein. For example, the method may comprise providing a dishwasher comprising a tub for receiving dishware and a circulation system for circulating fluid within the tub. The method may further comprise positioning a silverware basket within the tub so as to be in fluid communication with the circulation system. The silverware basket includes a basket portion configured to receive dishware therein and a handle portion defining at least one spray jet opening. The at least one spray jet opening is configured to be in fluid communication with the circulation system and to direct fluid toward the basket portion. In some embodiments, the method may comprise providing an air circulation system for circulating air through the handle portion. The method may further comprise positioning the silverware basket within the tub so as to be in fluid communication with the air circulation system.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A dishwasher comprising:

a tub configured to receive dishware;

a liquid circulation system configured to circulate a liquid fluid within the tub; and a silverware basket disposed within the tub and comprising a handle portion and a basket portion, wherein the basket portion is configured to receive dishware therein, wherein the handle portion defines at least one spray jet opening, wherein the at least one spray jet opening is configured to be in fluid communication with the circulation system and configured to direct fluid toward the basket portion.

2. The dishwasher of claim 1, wherein the handle portion defines an internal channel configured to be in fluid communication with the at least one spray jet opening and the circulation system.

3. The dishwasher of claim 1, further comprising a fluid branch, wherein the circulation system comprises a circulation pump in fluid communication with a circulation conduit, and wherein the fluid branch extends from the circulation conduit.

4. The dishwasher of claim 3, wherein the handle portion is removably attached to the fluid branch so as to selectively enable fluid communication between the circulation conduit and the at least one spray jet opening.

5. The dishwasher of claim 1, wherein the handle portion is disposed above the basket portion, and wherein the at least one spray jet opening is positioned on the handle portion above the basket portion.

6. The dishwasher of claim 1, wherein the silverware basket further comprises at least one spray head for each corresponding spray jet opening.

7. The dishwasher of claim 6, wherein the at least one spray head is configured to rotate.

8. The dishwasher of claim 1 further comprising an air circulation system for circulating air through the handle portion, wherein the at least one spray jet opening is configured to be in fluid communication with the air circulation system and configured to direct air toward the basket portion.

9. The dishwasher of claim 8 further comprising a control device configured to control operation of the liquid circulation system and the air circulation system, and wherein the control device is configured to switch between operation of the liquid circulation system and the air circulation system so as to control when a liquid fluid is directed toward the basket portion of the silverware basket through the at least one spray jet opening and when air is directed toward the basket portion of the silverware basket through the at least one spray jet opening.

10. The dishwasher of claim 1, wherein the basket portion defines a first section and a second section, wherein the first section and the second section are each configured to receive dishware therein, and wherein the handle portion defines a first spray jet opening configured to direct fluid into the first section and a second spray jet opening configured to direct fluid into the second section.

11. The dishwasher of claim 1, wherein the handle portion defines a plurality of spray jet openings.

12. The dishwasher of claim 1 further comprising a lower dish rack positioned within the tub, and wherein the silverware basket is removably positioned within the lower dish rack and removably attached to the circulation system.

13. The dishwasher of claim 12, wherein the lower dish rack is configured to translate between a first position within the tub and a second position disposed therefrom, wherein the handle portion is configured to be selectively in fluid communication with the circulation system when the silverware basket is within the lower dish rack and the lower dish rack is disposed in the first position and not in fluid communication with the circulation system when the silverware basket is removed from the lower dish rack or the lower dish rack is disposed in the second position.

14. The dishwasher of claim 12 further comprising a lower spray arm positioned below the lower dish rack and in fluid communication with the circulation system.

15. A silverware basket for a dishwasher, wherein the dishwasher comprises a tub for receiving dishware and a circulation system for circulating fluid within the tub, wherein the silverware basket is configured to be positioned within the tub, the silverware basket comprising:

a basket portion configured to receive silverware therein; and a handle portion that defines at least one spray jet opening, wherein the at least one spray jet opening is configured to be in fluid communication with the circulation system of the dishwasher, wherein the at least one spray jet opening is configured to direct fluid toward the basket portion.

16. The silverware basket of claim 15, wherein the handle portion defines an internal channel that is configured to be in fluid communication with the at least one spray jet opening and the circulation system.

17. The silverware basket of claim 15, wherein the circulation system comprises a circulation pump in fluid communication with a circulation conduit, wherein the dishwasher comprises a fluid branch that extends from the circulation conduit, and wherein the handle portion is configured to removably attach to the fluid branch so as to selectively enable fluid communication between the circulation conduit and the at least one spray jet opening.

18. The silverware basket of claim 15, wherein the handle portion is disposed above the basket portion, and wherein the at least one spray jet opening is positioned on the handle portion above the basket portion.

19. A method of operating a dishwasher, wherein the dishwasher comprises a tub for receiving dishware and a circulation system for circulating fluid within the tub, the method comprising:

providing a silverware basket configured to be positioned within the tub, wherein the silverware basket comprises:

a basket portion configured to receive dishware therein, and a handle portion defining at least one spray jet opening, wherein the at least one spray jet opening is configured to be in fluid communication with the circulation system and configured to direct fluid toward the basket portion; and circulating fluid to the handle portion of the silverware basket to direct fluid toward the basket portion of the silverware basket.

20. The method of claim 19 further comprising circulating air to the handle portion of the silverware basket to direct air into the basket portion of the silverware basket.

* * * * *